US009273262B2

(12) United States Patent
Kamikawa et al.

(10) Patent No.: US 9,273,262 B2
(45) Date of Patent: Mar. 1, 2016

(54) GREEN PELLET

(75) Inventors: Susumu Kamikawa, Hiroshima (JP); Hiroshi Nakajima, Hiroshima (JP); Keiichi Sato, Hiroshima (JP); Khanhson Pham, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 315 days.

(21) Appl. No.: 13/701,727

(22) PCT Filed: Jun. 16, 2010

(86) PCT No.: PCT/JP2010/060159

§ 371 (c)(1),
(2), (4) Date: Jan. 25, 2013

(87) PCT Pub. No.: WO2011/158338

PCT Pub. Date: Dec. 22, 2011

(65) Prior Publication Data

US 2013/0111809 A1 May 9, 2013

(51) Int. Cl.

| | |
|---|---|
| ***C10L 10/00*** | (2006.01) |
| ***C10L 5/32*** | (2006.01) |
| ***C22B 1/24*** | (2006.01) |
| ***C22B 1/245*** | (2006.01) |

(52) U.S. Cl.
CPC . *C10L 5/32* (2013.01); *C22B 1/245* (2013.01); *C22B 1/2406* (2013.01)

(58) Field of Classification Search
CPC ..... C10L 5/32; C22B 1/2406; C22B 1/245
USPC ..... 44/603
See application file for complete search history.

(56) References Cited

U.S. PATENT DOCUMENTS

| | | | |
|---|---|---|---|
| 6,241,808 | B1 | 6/2001 | Morioka et al. |
| 2004/0216280 | A1 | 11/2004 | Tetsumoto et al. |

FOREIGN PATENT DOCUMENTS

| | | | | |
|---|---|---|---|---|
| DE | 2 306 647 | A1 | | 8/1974 |
| JP | 63-312920 | A | | 12/1988 |
| JP | 2000-87149 | A | | 3/2000 |
| JP | 2000-192154 | A | | 7/2000 |
| JP | 2000192154 | A | * | 7/2000 |

(Continued)

OTHER PUBLICATIONS

English Translation of JP 2005194544A.*

(Continued)

*Primary Examiner* — James Goloboy
*Assistant Examiner* — Latosha Hines
(74) *Attorney, Agent, or Firm* — Birch, Stewart, Kolasch & Birch, LLP

(57) ABSTRACT

Provided is a green pellet (10) which comprises: an inner core layer (11) containing an iron oxide-containing starting material, a carbonaceous material for reduction, and a slag-forming agent; and a coating layer (12) disposed so as to encapsulate the surface of the inner core layer (11), wherein the coating layer (12) is formed from a protective layer (12*a*), which is disposed so as to encapsulate the surface of the inner core layer (11) and which contains an inorganic compound (includes an alkali metal oxide) having a melting point that is 750°C. or greater but less than 1100°C., and a combustion layer (12*b*), which is disposed so as to encapsulate the surface of the protective layer (12*a*) and which contains the carbonaceous material.

4 Claims, 3 Drawing Sheets

(56) References Cited

FOREIGN PATENT DOCUMENTS

| | | | | |
|---|---|---|---|---|
| JP | 2003-129142 | A | | 5/2003 |
| JP | 2005-194544 | A | | 7/2005 |
| JP | 2005194544 | A | * | 7/2005 |
| JP | 2005-220398 | A | | 8/2005 |

OTHER PUBLICATIONS

English Translation of JP 2000-192154A.*
English Translation of JP 2005-194544.*
Office Action issued Jul. 17, 2013 for Chinese Application No. 201080067390.4 with a partial English Translation.

* cited by examiner

PRIOR ART

GREEN PELLET

TECHNICAL FIELD

The present invention relates to a green pellet obtained by mixing and pelletizing an iron oxide-containing starting material, a carbonaceous material for reduction, and a slag-forming agent, followed by coating with a carbonaceous material for combustion. In particular, the present invention relates to a green pellet used in a partial reduction furnace in which reduction is carried out by heating with an oxygen-containing gas flowing through a packed bed.

BACKGROUND ART

The following green pellets and the like are conventionally known. Specifically, one is a green pellet comprising an inner core layer 111 in which an iron ore powder, a carbonaceous material, and a lime-based auxiliary starting material are mixed with each other, a first coating layer 112 which covers the inner core layer 111 and which is made of an iron ore powder, and a second coating layer 113 which covers the first coating layer 112 and which is made of a carbonaceous material (see FIG. 3A), as described in Patent Literature 1 listed below and the like and proposed as production of partially reduced iron by use of a sintering machine. Another is a green pellet having a coating layer 122 containing CaO at 25% by weight or more and being disposed on a surface of a particulate body 121 in which a powdery iron starting material and a powdery solid reducing agent are mixed with each other, as described in Patent Literature 2 listed below and the like (see FIG. 3B).

Suppose a case where the conventional green pellet 110 described in Patent Literature 1 listed below and the like is supplied to a partial reduction furnace of a packed bed-type such as a sintering machine. In such a case, the lime-based auxiliary starting material in the inner core layer 111 forms a calcium ferrite-based melt, as the combustion of the carbonaceous material proceeds. Part of the melt oozes so as to be absorbed into the iron ore powder in the first coating layer 112, and partially melts the iron ore powder in the first coating layer 112. The rest of the iron ore powder in the first coating layer 112 is calcined, and a dense solidified layer surrounding the inner core layer 111 is formed after the calcination. Consequently, a pellet can be obtained which is prevented from reoxidation due to a reaction of the partially reduced iron with oxygen in the air.

Meanwhile, suppose a case where the conventional green pellet 120 described in Patent Literature 2 listed below and the like is supplied to a partial reduction furnace. Also in such a case, CaO in the coating layer 122 functions as a flux for forming a low-melting compound, and forms a melt layer by a reaction with iron. Thus, a pellet can be obtained which is prevented from reoxidation by blocking the contact of iron with supplied air.

CITATION LIST

Patent Literature

Patent Literature 1: Japanese Patent Application Publication No. 2005-194544

Patent Literature 2: Japanese Patent Application Publication No. 2000-192154

Patent Literature 3: Japanese Patent Application Publication No. 2005-220398

SUMMARY OF INVENTION

Technical Problem

However, in the case of each of the above-described conventional green pellets 110 and 120, the coating film is formed by a melting reaction between powdery lime and powdery iron oxide coming into contact with each other. Hence, if a non-contact portion is formed where the powdery lime and the powdery iron oxide are not in contact with each other, the coating film cannot be formed in the non-contact portion, and avoid is formed in this portion. As a result, it is difficult to stably suppress the reoxidation.

Here, the melt is formed in a larger amount by increasing the calcination temperature (exceeding 1300° C.) in order to form the coating film also in the above-described non-contact portion. In this case, there is a problem that the green pellet 110 or 120 takes an excessively molten state, and deforms, which in turn impairs the gas permeability, and inhibits the reduction reaction.

Under such a background, an object of the present invention is to provide a green pellet from which a pellet whose reoxidation is stably suppressed can be easily obtained without increase in the calcination temperature.

Solution to Problem

A green pellet according to a first aspect of the invention for solving the above-described problems is a green pellet characterized by comprising: an inner core layer containing an iron oxide-containing starting material, a carbonaceous material for reduction, and a slag-forming agent; and a coating layer disposed so as to surround a surface of the inner core layer, wherein the coating layer contains an inorganic compound having a melting point that is 750° C. or higher and lower than 1100° C., and a carbonaceous material for combustion.

A green pellet according to a second aspect of the invention is the green pellet according to the first aspect of the invention, characterized in that the inorganic compound in the coating layer contains an alkali metal oxide.

A green pellet according to a third aspect of the invention is the green pellet according to the second aspect of the invention, characterized in that the coating layer contains the inorganic compound such that the weight ratio of the contained alkali metal oxide to the inner core layer is 0.15 to 1.5% by weight.

A green pellet according to a fourth aspect of the invention is the green pellet according to any one of the first to third aspects of the invention, characterized in that the coating layer comprises: a protective layer which is disposed so as to surround the surface of the inner core layer and which contains the inorganic compound; and a combustion layer which is disposed so as to surround a surface of the protective layer and which contains the carbonaceous material for combustion.

Advantageous Effects of Invention

In the case of the green pellet according to the present invention, the inorganic compound in the coating layer melts by itself to form a melt, and covers the surface of the inner core layer in such a low temperature range that the inorganic compound does not react with particles constituting the inner core layer. Hence, the entire surface of the inner core layer is surely covered with a void-free melt layer in the above-described temperature range. Therefore, it is possible to easily obtain a pellet whose reoxidation is stably suppressed, without increasing the calcination temperature.

DESCRIPTION OF EMBODIMENTS

Embodiments of a green pellet according to the present invention will be described below based of the drawings. However, the present invention is not limited exclusively to the embodiments described blow.

<First Embodiment>

Figure 1:
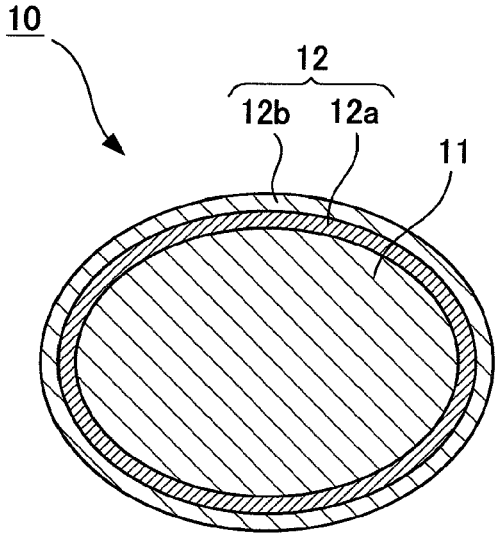
FIG. 1 is a schematic structural view of a first embodiment of a green pellet according to the present invention.

A first embodiment of the green pellet according to the present invention is described based on FIG. 1.

As shown in FIG. 1, the green pellet according to this embodiment is a green pellet 10 comprising: an inner core layer 11 containing an iron oxide-containing starting material, a carbonaceous material for reduction, and a slag-forming agent; and a coating layer 12 disposed so as to surround a surface of the inner core layer 11, wherein the coating layer 12 comprises: a protective layer 12*a* which is disposed so as to surround the surface of the inner core layer 11, and which contains an inorganic compound having a melting point that is 750° C. or higher and lower than 1100° C.; and a combustion layer 12*b* which is disposed so as to surround a surface of the protective layer 12*a*, and which contains a carbonaceous material for combustion.

Examples of the iron oxide-containing starting material in the inner core layer 11 include iron ores, steel works dusts (sintering machine dust, blast furnace dust, converter dust, rolling mill sludge, and the like), and the like. Examples of the carbonaceous material for reduction include coal, coke, char, oil coke, and the like. Examples of the slag-forming agent include lime-based slag-forming agents such as limestone, refining slag, cement, slaked lime, quicklime, dolomite, and calcined dolomite.

Examples of the inorganic compound in the protective layer 12*a* include inorganic glasses composed of $SiO_2$ and alkali metal oxides including $Na_2O$, $K_2O$, and the like, and the like.

Examples of the carbonaceous material for combustion in the combustion layer 12*b* include the same carbonaceous materials as those exemplified as the carbonaceous material for reduction in the inner core layer 11.

The green pellet 10 according to this embodiment can be produced easily, for example, as follows. Specifically, a powder of the above-described iron oxide-containing starting material (for example, average diameter: approximately about 30 to 50 μm, percentage: approximately around 75% by weight), a powder of the carbonaceous material for reduction (for example, average diameter: approximately about 30 to 50 μm, percentage: approximately around 20% by weight), and a powder of the above-described slag-forming agent (for example, average diameter: approximately about 30 to 50 μm, percentage: approximately around 5% by weight) are mixed with each other together with water (in an appropriate amount) and a binder (in an appropriate amount, if necessary). Then, the mixture is pelletized (for example, average diameter: approximately about 3 to 10 mm) to produce the inner core layer 11. The inner core layer 11 is introduced into a mixing apparatus such as a mixer, and a powder of the above-described inorganic compound (for example, average diameter: approximately about 30 to 50 μm) is also introduced (for example, approximately 1 to 10% by weight relative to the inner core layer 11) thereinto to coat a surface of the inner core layer 11 with the above-described protective layer 12*a*. Then, a powder of the above-described carbonaceous material for combustion (for example, average diameter: approximately about 30 to 50 μm) is introduced (for example, approximately around 5% by weight relative to the inner core layer 11) thereinto, and a binder (in an appropriate amount, if necessary) is further added thereto. Thus, a surface of the above-described protective layer 12*a* is coated with the above-described combustion layer 12*b*, so that the coating layer 12 is disposed. Then, the pellet is taken out from the mixing apparatus, and dried.

Suppose a case where the thus obtainable green pellet 10 according to this embodiment is supplied to a partial reduction furnace of a packed bed-type such as a sintering machine, and the combustion layer 12*b* in the coating layer 12 is combusted. In this case, as the temperature increases with the combustion (750° C. or higher and lower than 1100° C.), the inorganic compound in the protective layer 12*a* melts by itself to form a melt, and covers the entire surface of the inner core layer 11 without formation of any voids. In addition, the molten inorganic compound enters fine pores formed on the surface of the inner core layer 11, and blocks the pores.

As the temperature further increases subsequently (1100 to 1300° C.), the iron oxide in the inner core layer 11 is reduced with the carbon in the inner core layer 11, a melt is formed locally by the slag-forming agent, and the pellet shrinks, so that pores thorough which oxygen enters are further reduced in number.

During the reduction and shrinkage in this manner, the melt follows this change, and covers the entire surface of the inner core layer 11 without formation of any voids. In addition, the melt enters the pores and the like to block the pores and the like. Hence, the inner core layer 11 is prevented from the direct contact with the outside air, and the reoxidation is prevented at a high-temperature range after the reduction.

Then, as the temperature drops (below 1100° C.), the protective layer 12*a* in the molten state solidifies to form a shell, and consequently shields the inner core layer 11.

In other words, the green pellet 10 according to this embodiment is configured such that the inorganic compound in the protective layer 12*a* melts by itself to form a melt, and covers the surface of the inner core layer 11 in a temperature range (750° C. or above) where the oxidation reaction rate is high before the reduction occurs in the inner core layer 11 (lower than 1100° C.)

For this reason, the green pellet 10 according to this embodiment makes it possible to surely cover the entire surface of the inner core layer 11 with a void-free melt layer in the above-described temperature range (750° C. or higher and lower than 1100° C.)

Accordingly, the green pellet 10 according to this embodiment makes it possible to easily obtain a pellet whose reoxidation is stably suppressed, without increase in the calcination temperature (exceeding 1300° C.)

In addition, the inorganic compound in the protective layer 12*a* reacts also with oxides such as CaO and $SiO_2$ which is present on the surface of the inner core layer 11 and which comes into contact with the inorganic compound, and melts the oxides at the reduction and sintering temperature (1100 to 1300° C.) of the inner core layer 11, to further form the melt. Hence, the amount of the melt covering the surface of the inner core layer 11 can be increased. For this reason, a melt film having a sufficient thickness can be formed even when the amount of the inorganic compound in the protective layer 12*a* is small, so that the material costs can be reduced.

Note that the protective layer 12*a* in the coating layer 12 is preferably obtained by disposing the inorganic compound on the inner core layer 11 such that the weight ratio of the contained alkali metal oxide is 0.15 to 1.5% by weight relative to the inner core layer 11. In other words, the protective layer 12*a* is preferably made of the inorganic compound disposed in such an amount that the ratio of the inorganic compound is approximately 1 to 10% by weight relative to the inner core layer 11.

This is because of the following reasons. Specifically, it is difficult to sufficiently suppress the reoxidation (a pellet metallization percentage of 60% or higher), when the protective layer 12*a* is obtained by disposing the inorganic compound in such an amount that the content ratio of the alkali metal oxide is less than 0.15% by weight relative to the inner core layer 11, in other words, when the protective layer 12*a* is made of the inorganic compound disposed in such an amount that the ratio of the inorganic compound is less than approximately 1% by weight relative to the inner core layer 11. On the other hand, the possibility of excessive melting is increased, when the protective layer 12*a* is obtained by disposing the inorganic compound in such an amount that the content ratio of the alkali metal oxide exceeds 1.5% by weight relative to the inner core layer 11, in other words, when the protective layer 12*a* is made of the inorganic compound disposed in such an amount that the ratio of the inorganic compound exceeds approximately 10% by weight relative to the inner core layer 11.

<Second Embodiment>

Figure 2:
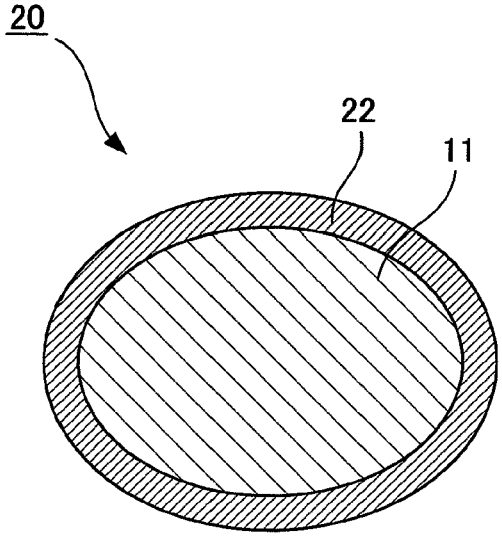
FIG. 2 is a schematic structural view of a second embodiment of the green pellet according to the present invention.
Figure 3A:
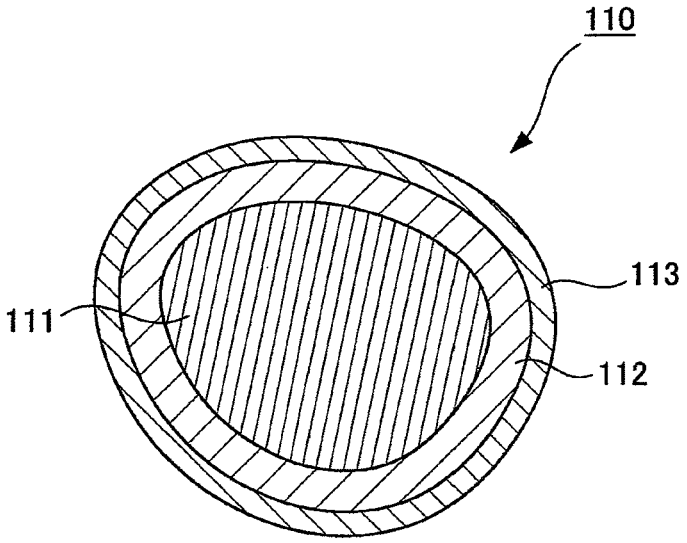
FIG. 3 is schematic structural views of conventional green pellets.
Figure 3B:
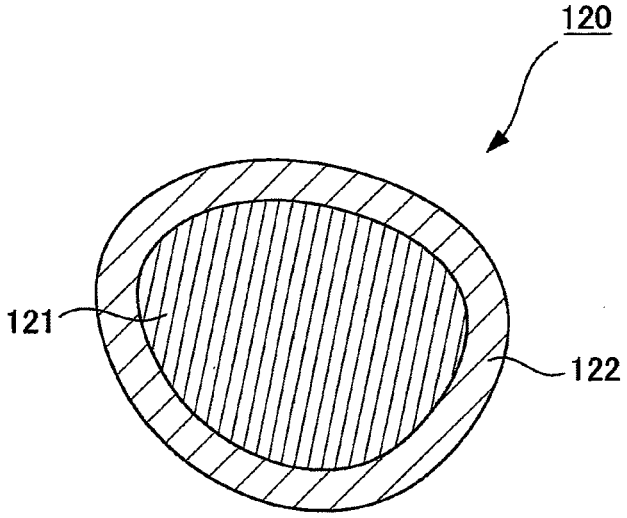
PRIOR ART FIG. 3B

A second embodiment of the green pellet according to the present invention is described based on FIG. 2. However, portions which are similar to or the same as those in the case of the above-described first embodiment are denoted by reference signs similar to or the same as those used in the description of the first embodiment above, and descriptions overlapping with those in the first embodiment are omitted.

As shown in FIG. 2, the green pellet according to this embodiment is a green pellet 20 comprising: an inner core layer 11 containing an iron oxide-containing starting material, a carbonaceous material for reduction, and a slag-forming agent, and a coating layer 22 disposed so as to surround a surface of the inner core layer 11, wherein the coating layer 22 contains an inorganic compound having a melting point that is 750° C. or higher and lower than 1100° C. and a carbonaceous material for combustion.

Such a green pellet 20 according to this embodiment can be easily produced, for example, as follows. Specifically, the inner core layer 11 is produced in the same manner as that for the green pellet 10 according to the above-described embodiment. The inner core layer 11 is introduced into a mixing apparatus such as a mixer. In addition, a powder of the inorganic compound and the carbonaceous material for combustion, which are the same as those in the above-described embodiment, are also introduced into the mixing apparatus, and a binder (in an appropriate amount, if necessary) is further added thereto. Thus, the above-described coating layer 22 is disposed on a surface of the inner core layer 11. Then, the pellet is taken out from the mixing apparatus, and dried.

In other words, in the description of the case of the green pellet 10 according to the above-described embodiment, the coating layer 12 is constituted of the two layers including the protective layer 12*a* which is obtained by disposing the inorganic compound so as to surround the surface of the inner core layer 11 and the combustion layer 12*b* obtained by disposing the carbonaceous material for combustion so as to surround the surface of the protective layer 12*a*. In contrast, in the case of the green pellet 20 according to this embodiment, the coating layer 22 is constituted of a single layer by mixing the inorganic compound and the carbonaceous material for combustion with each other, and disposing the mixture so as to surround the surface of the inner core layer 11.

Accordingly, the green pellet 20 according to this embodiment achieves, as a matter of course, the same operation and effect as those achieved in the case of the green pellet 10 according to the above-described embodiment, and moreover makes it possible to simplify the production, because the coating layer 22 can be disposed by a single operation.

Note that the coating layer 22 preferably contains the inorganic compound such that the weight ratio of the contained alkali metal oxide is 0.15 to 1.5% by weight relative to the inner core layer 11, in other words, contains the inorganic compound in such an amount that the ratio of the inorganic compound is approximately 1 to 10% by weight relative to the inner core layer 11.

This is because of the following reasons. Specifically, it is difficult to sufficiently suppress the reoxidation (a pellet metallization percentage of 60% or higher), when the coating layer 22 contains the inorganic compound in such an amount that the content ratio of the alkali metal oxide is less than 0.15% by weight relative to the inner core layer 11, in other words, when the coating layer 22 contains the inorganic compound in such an amount that the ratio of the inorganic compound is less than approximately 1% by weight relative to the inner core layer 11. On the other hand, the possibility of the excessive melting is increased, when the coating layer 22 contains the inorganic compound in such an amount that the content ratio of the alkali metal oxide exceeds 1.5% by weight relative to the inner core layer 11, in other words, when the coating layer 22 contains the inorganic compound in such an amount that the ratio of the inorganic compound exceeds approximately 10% by weight relative to the inner core layer 11.

INDUSTRIAL APPLICABILITY

The green pellet according to the present invention makes it possible to easily obtain a pellet whose reoxidation is stably suppressed, without increase in the calcination temperature, and hence can be used with great usefulness in the iron and steel industries.

REFERENCE SIGNS LIST

10 green pellet
11 inner core layer
12 coating layer
12*a* protective layer
12*b* combustion layer
20 green pellet
22 coating layer

The invention claimed is:

1. A green pellet comprising:

an inner core layer containing an iron oxide-containing starting material, a carbonaceous material for reduction, and a slag-forming agent; and a coating layer disposed so as to surround a surface of the inner core layer, wherein the coating layer contains a carbonaceous material for combustion and an inorganic compound having a melting point that is 750°C. or higher and lower than 1100°C.

2. The green pellet according to claim 1, wherein the inorganic compound in the coating layer contains an alkali metal oxide.

3. The green pellet according to claim 2, wherein the coating layer contains the inorganic compound such that the weight ratio of the contained alkali metal oxide to the inner core layer is 0.15 to 1.5% by weight.

4. The green pellet according to claim 1, wherein the coating layer comprises:

a protective layer which is disposed so as to surround the surface of the inner core layer and which contains the inorganic compound; and a combustion layer which is disposed so as to surround a surface of the protective layer and which contains the carbonaceous material for combustion.

* * * * *